US008960087B2

(12) United States Patent
Preisner et al.

(10) Patent No.: US 8,960,087 B2
(45) Date of Patent: Feb. 24, 2015

(54) METHOD FOR APPLYING A FILM

(75) Inventors: Mario Preisner, Kirchheim/Teck (DE); Michael Zinke, Limburg (DE)

(73) Assignee: manroland sheetfed GmbH, Offenbach (DE)

( * ) Notice: Subject to any disclaimer, the term of this patent is extended or adjusted under 35 U.S.C. 154(b) by 1540 days.

(21) Appl. No.: 11/578,085

(22) PCT Filed: Apr. 13, 2005

(86) PCT No.: PCT/EP2005/003879

§ 371 (c)(1),
(2), (4) Date: Jan. 5, 2007

(87) PCT Pub. No.: WO2005/100026

PCT Pub. Date: Oct. 27, 2005

(65) Prior Publication Data

US 2007/0240590 A1 Oct. 18, 2007

(30) Foreign Application Priority Data

Apr. 13, 2004 (DE) ..... 10 2004 018 306
Apr. 29, 2004 (DE) ..... 10 2004 021 102

(51) Int. Cl.
*B41F 19/06* (2006.01)
*B41M 1/24* (2006.01)
*B41M 5/03* (2006.01)

(52) U.S. Cl.
CPC ..... *B41F 19/062* (2013.01); *B41M 1/24* (2013.01); *B41M 5/03* (2013.01); *B41P 2217/11* (2013.01); *B41P 2217/14* (2013.01); *B41P 2219/50* (2013.01); *B41P 2219/51* (2013.01)
USPC ..... 101/34; 101/33

(58) Field of Classification Search
USPC ..... 101/33, 34; 156/235
IPC ..... B41F 19/06
See application file for complete search history.

(56) References Cited

U.S. PATENT DOCUMENTS 3,858,977 A 1/1975 Baird et al.
4,465,538 A 8/1984 Schmoock
(Continued)

FOREIGN PATENT DOCUMENTS

DE 831845 1/1952
EP 0148601 A2 7/1985
(Continued)

OTHER PUBLICATIONS

Derwent Abstract of WO 2005021276.*
(Continued)

*Primary Examiner* — Judy Nguyen
*Assistant Examiner* — Jennifer Simmons
(74) *Attorney, Agent, or Firm* — Leydig, Voit & Mayer, Ltd.

(57) ABSTRACT

A device and method for transferring an image-forming layer from a transfer foil to a printing sheet is provided. The device includes an application unit for coating an image area of the printing sheet with an adhesive pattern that is colored and a coating module for transferring the image-forming layer from the transfer foil to the printing sheet. The image forming layer having a visual effect. The color of the adhesive pattern and the visual effect of the image-forming layer are configured such that the color of the adhesive pattern modifies the visual effect of the image forming layer when the image forming layer is applied to the printing sheet over the adhesive pattern.

20 Claims, 3 Drawing Sheets

(56) References Cited

U.S. PATENT DOCUMENTS

| | | | | |
|---|---|---|---|---|
| 5,207,855 | A | 5/1993 | Nyfeler et al. | |
| 5,250,758 | A | 10/1993 | Fjelstad et al. | |
| 5,565,054 | A | 10/1996 | Lappe et al. | |
| 5,587,037 | A * | 12/1996 | Fellner | 156/231 |
| 5,603,259 | A | 2/1997 | Gross et al. | |
| 5,618,378 | A | 4/1997 | Cahill | |
| 5,775,225 | A | 7/1998 | Saitou | |
| 5,891,289 | A | 4/1999 | Zemel | |
| 6,170,881 | B1 * | 1/2001 | Salmon et al. | 283/91 |
| 6,395,120 | B1 | 5/2002 | Bradbury-Harris et al. | |
| 6,712,399 | B1 * | 3/2004 | Drinkwater et al. | 283/111 |
| 6,779,442 | B2 | 8/2004 | Strasser | |
| 6,811,863 | B2 | 11/2004 | Rizika et al. | |
| 6,909,444 | B2 | 6/2005 | Ishida et al. | |
| 2003/0211295 | A1 * | 11/2003 | Scarborough et al. | 428/195.1 |

FOREIGN PATENT DOCUMENTS

| | | | |
|---|---|---|---|
| EP | 0195857 | A2 | 10/1986 |
| EP | 0414362 | A2 | 2/1991 |
| EP | 0441596 | A1 | 8/1991 |
| EP | 0569520 | | 11/1993 |
| EP | 0945280 | A2 | 9/1999 |
| EP | 1147893 | A2 | 10/2001 |
| GB | 1574908 | | 9/1980 |
| JP | 2004101834 | A1 | 4/2004 |
| WO | WO 9212859 | A1 | 8/1992 |
| WO | WO 9413749 | A1 | 6/1994 |
| WO | WO 0234521 | A1 | 5/2002 |
| WO | WO 2004041546 | A1 | 5/2004 |
| WO | WO 2005021276 | A1 | 3/2005 |

OTHER PUBLICATIONS

"Prindor: Neue Technologie der Folienprägung—heriss oder kalt?", Deutscher Drucker, Deutscher Drucker Verlagsgesellschaft, Ostfildern, DE, Bd. 32, Nr. 14/15, Apr. 18, 1996, Seite G15, XP000584416 ISSN: 0012-1096 das ganze Dokument.

Walther T: "Offsetdruck und Folientransfer in nur einem Durchgang" Deutscher Drucker, Deutscher Drucker Verlagsgesellschaft, Ostfildern, DE, vol. 40, No. 15, Apr. 29, 2004, p. 42, 44, XP001196256 ISSN: 0012-1096, p. 42, col. 3, line 1-line 6.

Emeriau L: "La dorure est << Vernie >> Grace Au Dispositif Speedor D'Ecamo, La Dorure A Froid Sur Presse Offset" Caractere, CEP Information Professions. Paris, FR, vol. 45, No. 387/388, Oct. 4, 1994, pp. 146-147, XP000476375 ISSN: 0247-039X, p. 147, col. 1, line 12-line 25.

* cited by examiner

Fig. 3
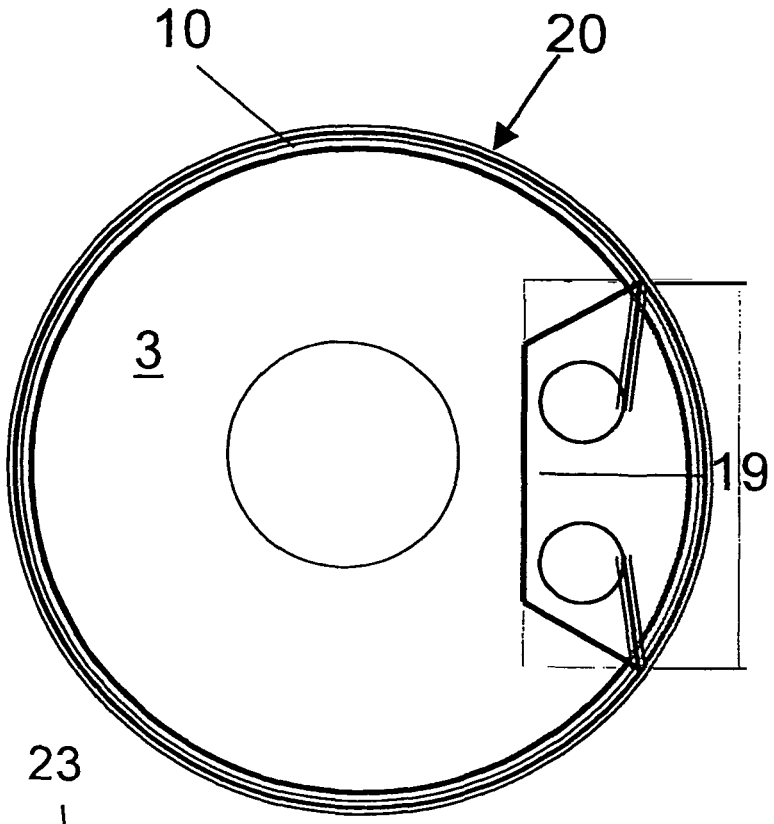
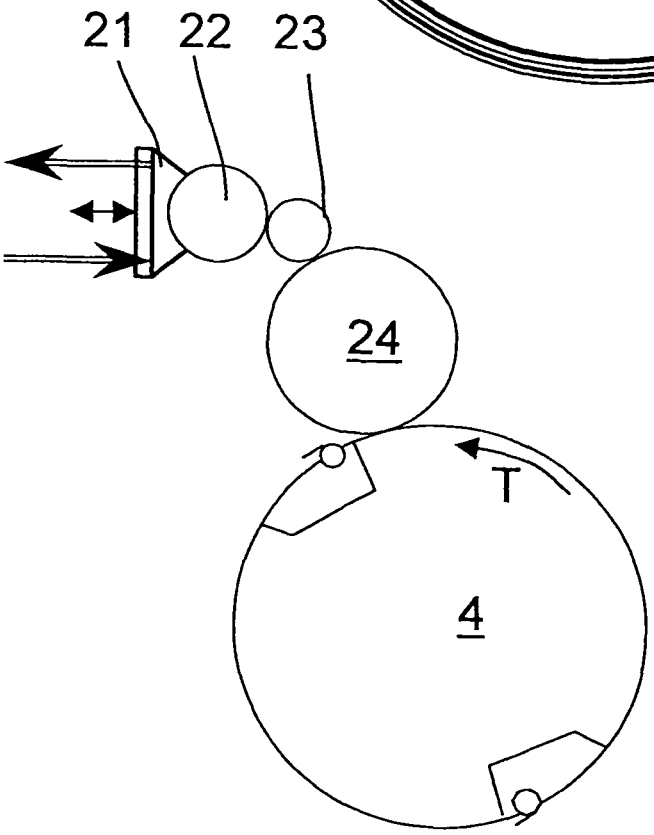
Fig. 4

METHOD FOR APPLYING A FILM

FIELD OF THE INVENTION

The present invention relates to a method and a device for transferring image-forming layers from a transfer foil onto a printing material.

BACKGROUND OF THE INVENTION

It is known to produce metallic layers on a material to be printed using a foil transfer method. For example, a printing material and a printing device using a foil material are described in EP 0 569 520 B1. In that reference, a sheet-processing machine is disclosed which has a feeder and a delivery system. Printing units and a coating module are arranged between the feeder and delivery system. In at least one of the printing units, an adhesive pattern is applied using a flat bed or lithographic printing method. The adhesive pattern is applied using a cold printing method and has a certain image-forming design. In the coating module following the printing unit, a foil guide is provided that includes an impression cylinder and a press cylinder. The foil guide is designed such that a foil strip or transfer foil is guided from a foil storage roll through a transfer gap in the coating module between the impression cylinder and the press cylinder. The foil strip is rewound on the delivery side after leaving the coating module. The transfer foil includes a carrier layer, on which image-forming layers, such as metallic layers (for example, made from aluminum) can be applied. A separating layer is provided between the metallic layer and the carrier layer. The separating layer ensures that the metallic layer can be removed from the carrier layer.

As each printing sheet is conveyed through the printing unit, it is provided with an adhesive pattern. The printing sheets are then guided through the coating module in which the printing sheet on the impression cylinder is brought into contact with the foil material via the press cylinder. During this process, the metallic layer on the bottom of the foil material is tightly bonded to the areas on the printing sheet provided with the adhesive. After additional transport of the printing sheet, the metallic layer adheres only in the area of the adhesive pattern. Thus, the metallic layer is removed from the carrier layer in the area of the adhesive pattern. The consumed transfer foil is then rewound. The printing sheet is delivered in the coated state.

Utilizing such coating modules, for example, in printing units of printing presses, is known. However, a disadvantage of these modules is that they cannot be flexibly utilized.

BRIEF SUMMARY OF THE INVENTION

In view of the foregoing, a general object of the invention is to provide a device that allows an image-forming layer (e.g., a metallic layer) to be transferred onto a printing sheet to be performed in a more reliable, economic and precise manner. Thus, the device is suitable for a broader spectrum of applications.

Advantageously, with the device of the present invention the adhesive pattern for transferring the image-forming layer from the transfer foil is created with a colored adhesive. As a result, the image-forming layer on the transfer foil can be transparent, semitransparent, opaque, or non-transparent.

The device of the present invention can also improve the utilization of the foil by dividing the transfer foil into one or more narrow partial foil strips. This also can allow different types of foils to be used concurrently along with differently colored adhesive patterns.

The use of colored adhesives can be used to compensate for very small surface defects, to intensify color effects, to combine or superimpose the color effects of the adhesive and the image-forming layer, or to support of a glossy effect provided by the image-forming coating. For example, the glossiness can be improved by applying the image-forming layer using so-called UV ground tints. The UV ground tint can be applied using the adhesive printing unit via an offset printing plate.

Advantageously, it is also possible to provide a sequential arrangement of several coating modules within a sheet-processing machine. In this way, various image-forming layers can be applied one after the other to produce a desired design. In such a case, the various image-forming layers can be transferred one next to the other using a single adhesive pattern that corresponds to all of the desired design elements. It is also possible to transfer a first image-forming layer using a first adhesive pattern and then apply a second adhesive pattern overlapping the first adhesive pattern which is then used to transfer another image-forming layer.

BRIEF DESCRIPTION OF THE DRAWINGS

FIG. 3 is a schematic side sectional view of the press cylinder of the coating module of FIG. 2.

FIG. 4 is an alternative embodiment of an application unit according to the invention.

DETAILED DESCRIPTION OF THE INVENTION

Figure 1:
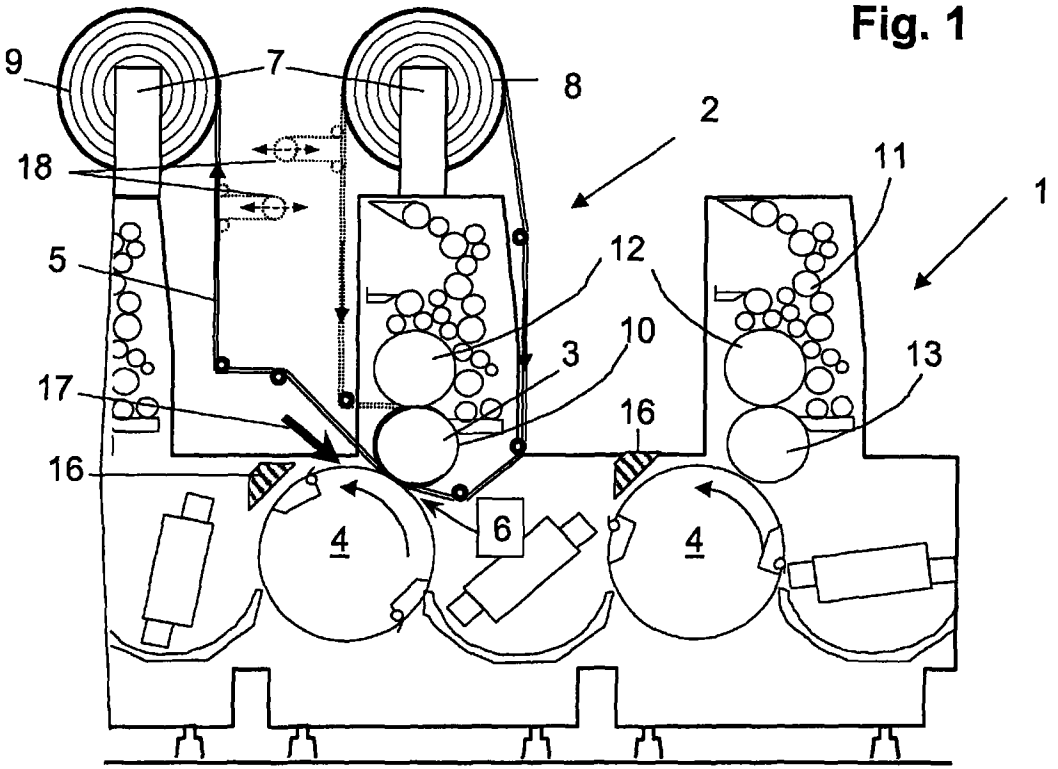
FIG. 1 is a schematic, partial side sectional view of an exemplary printing press having a foil-transfer device according to the present invention.

Referring to FIG. 1 of the drawings, a sheet-processing machine is shown, in this case a printing press, which includes at least two printing units. The two printing units can be used as described below to transfer an image-forming layer from a transfer foil to a printing sheet.

In a first step, a printing sheet to be coated is provided with an image-forming adhesive pattern. The application of the adhesive is carried out in an application unit 1, e.g., a conventional printing unit of an offset printing press. In this case, the application unit includes inking and dampening units 11, a printing plate on a plate cylinder 12, a blanket or rubber cylinder 13, and an impression cylinder 4. Application units in the form of flexographic printing units or varnishing units also can be used. An alternative embodiment of such an application unit is shown in FIG. 4. In the embodiment of FIG. 4, the adhesive is transferred to a form cylinder 24 using a metering system 21 via a screen roller 22 and a transfer roller 23. The form cylinder of the FIG. 4 embodiment carries a relief printing plate for creating the image-forming adhesive coating.

In a second step, a transfer foil 5 is guided together with a printing sheet through a transfer gap 6, with the transfer foil 5 being pressed against the printing sheet. In this case, a coating module 2 is used that can correspond to a printing unit, an inking module, a base unit or some other kind of processing station of an offset sheet printing press. In the illustrated embodiment, the transfer gap 6 in the coating module 2 is defined by a press cylinder 3 and an impression cylinder 4. In this case, the press cylinder 3 can correspond to a blanket cylinder and the impression cylinder 4 can correspond to an impression cylinder of a known offset printing unit. Furthermore, the press cylinder 3 can correspond to a form cylinder and the impression cylinder 4 can correspond to an impression cylinder of a varnishing module of a sheet printing press. In addition, a so-called calendaring unit can be arranged downstream of the coating module 2 if the coated printing sheets are to be rolled under elevated pressure to increase the adhesion of the coating or to increase the smoothness and gloss of the printing sheet.

A guide for a transfer foil is provided within the coating module 2. Transfer foils 5 that can be used have a multi-layer construction. In particular, the transfer foils can include a carrier layer on which an image-forming layer is applied over a separating layer. The separating layer is used to ease removal of the image-forming layer from the carrier layer. The image-forming layer can be, e.g., a metallic layer, a gloss layer, a textured layer, an inked layer or a layer containing one or more image patterns.

A foil storage roll 8 is provided on the sheet feeder side of the coating module 2. The foil storage roll 8 includes a controllable rotary drive 7. The rotary drive 7 can continuously control the feed of the transfer foil 5 to the coating module 2.

Guide devices 14, such as deflection or tension rollers, pneumatically activated guides, guide plates, or the like can be provided in the area of the foil feeder and delivery system. As a result, the web of the transfer foil 5 can always be guided in a flat, smooth and undistorted manner and at the same tension relative to the press cylinder 3. The guide devices 14 can also include elements for introducing the transfer foil 5. In this case, automatic drawing-in aids for the web of the transfer foil 5 can also be used. In this way, the foil feed in the area of various protective devices 15 surrounding the coating module 2 is simplified. The protective function of the protective devices 15 is simultaneously completely preserved.

In the illustrated embodiment, the transfer foil 5 can be guided around the press cylinder 3, with the transfer foil 5 advantageously only being fed and discharged to the transfer gap 6 from one side of the coating module 2 (see the dotted line representation in FIG. 1). Unlike as shown in FIG. 1, depending on the available space on one side of the coating module 2, the foil web can also be run with the incoming and outgoing strands running parallel and close to one another. In another embodiment, the transfer foil 5 can also be fed to and discharged from the transfer gap 6 such that the transfer foil passes the press cylinder 3 in a substantially tangential manner or such that the transfer foil is wrapped around only a small circumferential angle of the press cylinder. For this purpose, the transfer foil 5 can be fed from one side of the coating module 2 and discharged to the opposite side of the coating module 2.

A foil collecting roll 9 is provided on the delivery side of the printing unit. The used foil material is rewound on the foil collecting roll 9. In this case, a controllable rotary drive 7 can also be provided to optimize production. The transfer foil 5 could also be moved via the rotary drive 7 on the delivery side and could be held taut on the feeding side by a brake.

For the image-forming layer transfer process, it is important that the surface of the press cylinder 3 (i.e., the blanket or form cylinder) be equipped with a compressible, cushioning or dampening element. To this end, the press cylinder 3 can be provided with a press covering 10 or can comprise a cylinder with a corresponding coating. The press covering 10 or press coating can comprise, for example, a plastic coating, comparable to a rubber blanket or printing blanket. The surface of the press covering 10 or press coating is preferably very smooth. The surface of the press covering 10 can also be formed from non-adhesive material or structures. For example, a relatively rigid structure can be used in the form of very fine spherical segments. The press covering 10 is held on the press cylinder 3 via a clamping or gripping element provided in a cylinder channel.

In order to improve the transfer characteristics in the transfer gap 6, the press covering 10 can have a specific elasticity. This elasticity optionally can be achieved using a compressible intermediate layer. This compressibility is preferably similar to or less than that of conventional rubber or printing blankets, which can also be used for this purpose. This compressibility also can be produced using a conventional compressible printing blanket. Additionally, a covering consisting of a combination of a hard printing blanket and a soft bottom layer can be used. A limited press surface area also can be provided directly on the press cylinder 3 or on the press covering 10. This limited press surface are can be machined in the surface of the press covering 10 or it can be fixed to the press roll 3 as a sub-surface made of the same material as the press covering 10.

To improve the economic efficiency of the coating method, the advance of the transfer foil 5 from the foil storage roll 8 to the transfer gap 6 and then to the foil collecting roll 9 can be controllable in such a way that the advance of the transfer foil 5 is substantially stopped when no transfer of an image-forming layer is taking place. In this case, the advance of the transfer foil 5 can be controlled so that the advance is stopped during passage of a gripper channel of the sheet-guiding impression cylinder 4. These grippers hold the printing sheet on the impression cylinder 4. The press cylinder 3 has a corresponding cylinder channel 19 (see FIG. 3) in which the press covering 10 is held. In the area of the corresponding cylinder channels, the transfer foil 5 is not pressed between the press cylinder 3 (printing blanket cylinder) and the impression cylinder 4. Instead, the press cylinder 3 continues to run smoothly on the transfer foil 5, while the transfer foil 5 is left not touching anything between the press cylinder 3 and the impression cylinder 4. This state lasts until the so-called printing start of the cylinder channel 19 ends and the transfer foil 5 is clamped again between the press cylinder 3 and the impression cylinder 4 together with a printing sheet. The advance of the transfer foil 5 then resumes. The cycling of the foil advance can begin or stop somewhat earlier than defined by the channel edges of the cylinder channel in order to accommodate any necessary acceleration or braking of the foil storage roll 8 or foil collecting roll 9. For fast-reacting cycling systems using so-called dancer rolls 18 such as shown in FIG. 1, control of the rotary drives 7 of the foil storage rolls 8 and/or foil collecting rolls 9 may not be required. In such a case, the required foil tension can be maintained by means of the dancer rolls 18.

A further improvement in the transfer foil utilization can be achieved by dividing the transfer foil 5 into one or more narrower partial foil webs. If each of the partial foil webs is controlled accordingly with the help of the device or devices cycling the advance of the foil, the utilization of the transfer foil 5 can be improved when coating areas within a sheet that may have different lengths across the different zones to be coated. In particular, each partial foil web is forwarded in a precise manner only into the area where the image-forming surface layer is to be applied. In the areas not to be coated, each partial foil web can be stopped independently of the others so that no foil is wasted.

In order to further improve the coating method, a dryer 16 can be provided in the area of the adhesive application and in the area of the foil application. In this case, the applied adhesive layer can be dried using a first dryer 16 (intermediate dryer I) using a UV drying process so that the utility or image-forming layer of the transfer foil 5 adheres better. The adhesion of the image-forming layer pressed onto the printing sheet can be improved by using a second dryer 16 (intermediate dryer II) that further accelerates drying of the adhesive.

The quality of the coating can be controlled using an inspection or monitoring device 17 arranged after where the image-forming layer of the foil is transferred to the printing sheets. For this purpose, the inspection device 17 is directed towards a sheet-guiding area of the coating module 2 after the transfer gap 6 and, if applicable, sealed off from the dryer 16. Alternatively, the inspection device is directed towards a sheet-guiding area of another sheet-guiding module arranged after the coating module 2. The coated printing sheet passing by the inspection device can be checked for completeness and quality of the coating. Printing sheets identified as defective can be marked or sorted out as waste in a sorting device.

Figure 2:
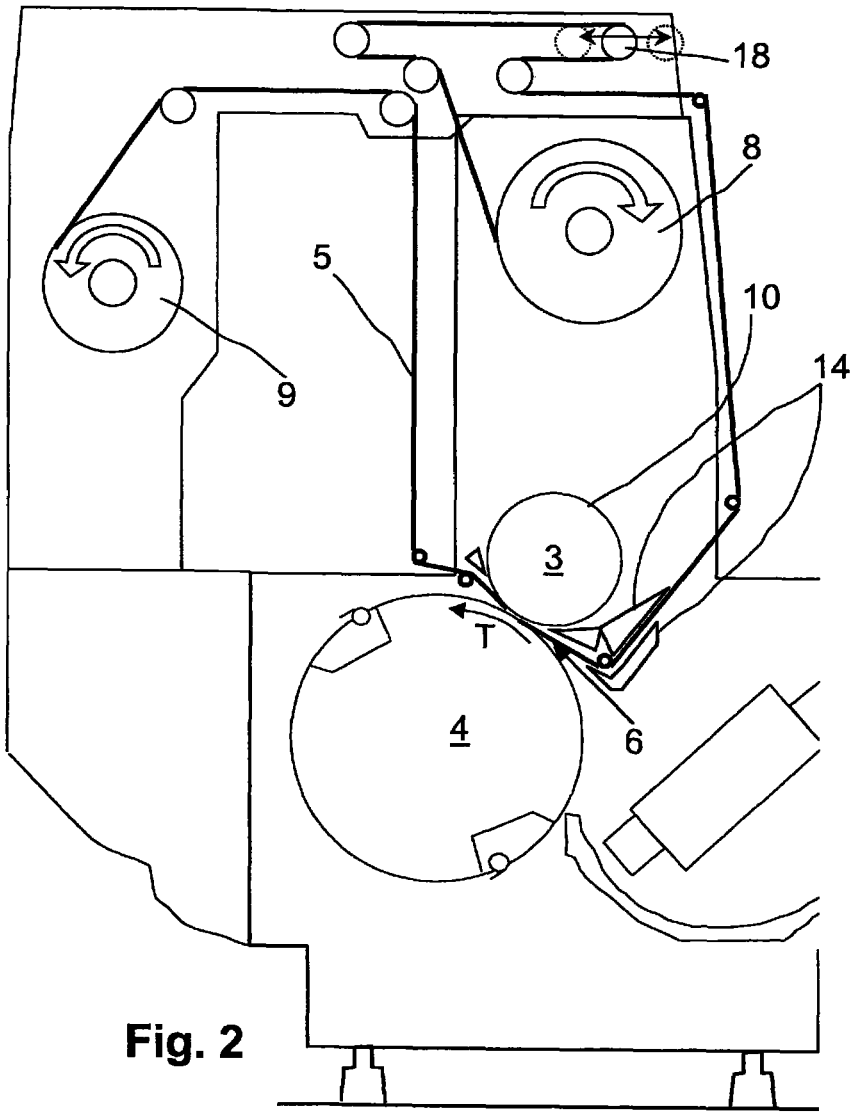
FIG. 2 is a schematic side sectional view of the coating module of the foil-transfer device of FIG. 1.

In order to improve the image-forming layer transfer and the ultimate finished coating, the coating module can be provided with devices for conditioning the transfer foil as shown in FIG. 2. In this case, the foil web 5 can be influenced by the foil guiding device 14.

According to one aspect of the invention, to enhance the visual effect of the image-forming layer of the transfer foils, the adhesive pattern applied to the printing sheet and to which the image-forming layer adhere can include a color. For example, the adhesive pattern can be colored with a gray tint for silver-colored or silver-luster foils. When using gold-colored or gold-luster metal foils, the adhesive pattern can be colored, for example, with a yellow tint. In this way, the appearance of the image-forming layer relative to the color of the underlying surface on the material to be printed can be enhanced as desired. Furthermore, the colored adhesive layer can enhance the color of the image-forming coating. This can permit the use of more economical foils. For example, the image-forming layer can be completely transparent, semi-transparent or opaque.

The effects that can be achieved using a colored adhesive include compensating for very small surface defects in the image-forming coating on the material to be printed. This can be accomplished either by adjusting the observed color or by covering the color of the underlying material to be printed. Another effect that can be achieved with a colored adhesive is the intensification of the color produced by transparent or semitransparent image-forming coatings by adding the color of the adhesive to that of the image-forming layer. Similarly, the color effects of the adhesive and the image-forming coating can be combined to provide a color mixture. A colored adhesive can also enhance the glossy effects of transparent or translucent image-forming coatings by adding the glossiness of the adhesive layer to that of the image-forming layer.

The use of a colored adhesive allows the visual effect of a particular image-forming coating to be influenced in a variety of ways thus expanding the range of high-quality coatings that can be achieved with the cold foil stamping method.

As noted above, to improve the glossiness, the image-forming layer can be applied using an adhesive that reacts with ultraviolet radiation. Colorless or colorable UV ground tints can be added. The UV ground tint is applied via the adhesive application unit 1 in a corresponding way via an offset printing plate. In this way, the adhesive can have an improved gloss, and thus the glossiness of the image-forming layer on the material to be printed is also enhanced. The adhesive effect of the UV ground tint can be completely utilized and the smoothness of the coating is increased.

LIST OF REFERENCE SYMBOLS

1 Application unit
2 Coating module
3 Press cylinder
4 Impression cylinder
5 Transfer foil/foil web
6 Transfer gap
7 Roll drive
8 Foil storage roll
9 Foil collecting roll
10 Press covering
11 Inking/dampening unit
12 Plate cylinder
13 Printing blanket/rubber cylinder
14 Foil guide device
15 Printing unit protective device
16 Dryer
17 Inspection device/monitoring system
18 Dancer roll
19 Cylinder channel
20 Press surface
21 Metering system
22 Screen roller
23 Transfer roller
24 Form cylinder

The invention claimed is:

1. A method for transferring a transparent image-forming layer from a transfer foil to a printing material in a sheet-fed printing machine comprising the steps of:

coating an image area of the printing material with a colored adhesive in an application unit;

guiding the transfer foil together with the printing material through a transfer gap in a coating module defined by an impression cylinder and a press cylinder, the transfer foil including a coating side having a transparent image-forming layer that is in contact with the printing material as the transfer foil and printing material are guided through the transfer gap such that the transparent image-forming layer is transferred to the image area of the printing material having the colored adhesive;

said color of the adhesive underlying the transparent image forming layer modifying the appearance and visual effect of the entire transparent image-forming layer and the underlying adhesive as viewed through the transparent image-forming layer including an area of the transparent image forming layer where the adhesive completely underlies the transparent image forming layer when the transparent image forming layer is applied to the printing sheet over the adhesive pattern.

2. The method according to claim 1 further including the step of drying the colored adhesive layer using UV radiation.

3. The method according to claim 2 further including the step of printing an image over the image-forming layer transferred onto the printing material in a printing unit arranged downstream of the coating module.

4. The method according to claim 1 in which said adhesive has a color other than black.

5. The method according to claim 4 in which said transparent image forming layer has a different color from the color of said adhesive.

6. The method according to claim 5 in which said adhesive is colored with a gray tint and said foil is silver colored.

7. The method according to claim 5 in which said adhesive is colored yellow and said foil is gold colored.

8. The method according to claim 1 in which the adhesive has a UV ground tint that reacts with ultraviolet radiation.

9. The method according to claim 1 in which the adhesive is colored with a gray or yellow tint.

10. The method according to claim 1 in which the transparent image forming layer is silver or gold colored.

11. The method according to claim 1 in which the adhesive has a ground tint that reacts with ultraviolet radiation to enhance the glossiness of the adhesive and image forming layer.

12. The method according to claim 1 including successively applying a plurality of different image forming layers onto the colored adhesive image area.

13. The method according to claim 1 including applying a second image area of colored adhesive onto and in overlying relation to the previously transferred transparent image forming layer to the transfer foil, and then applying a second transparent image forming layer from a second transfer foil onto and in overlying relation to the second colored adhesive image area.

14. A method for transferring a semi-transparent image-forming layer from a transfer foil to a printing material in a sheet-fed printing machine comprising the steps of:

coating an image area of the printing material with a colored adhesive in an application unit;

guiding the transfer foil together with the printing material through a transfer gap in a coating module defined by an impression cylinder and a press cylinder, the transfer foil including a coating side having a semi-transparent image-forming layer that is in contact with the printing material as the transfer foil and printing material are guided through the transfer gap such that the semi-transparent image-forming layer is transferred to the image area of the printing material having the colored adhesive said color of the adhesive underlying the semi-transparent image forming layer modifying the appearance and visual effect of the entire semi-transparent image-forming layer and the underlying adhesive as viewed through the semi-transparent image-forming layer including an area of the semi-transparent image forming layer where the adhesive completely underlies the image forming layer when the semi-transparent image forming layer is applied to the printing sheet over the adhesive pattern.

15. The method according to claim 14 further including the step of drying the colored adhesive layer using UV radiation.

16. The method according to claim 15 further including the step of printing an image over the semi-transparent image-forming layer transferred onto the printing material in a printing unit arranged downstream of the coating module.

17. The method according to claim 14 in which said adhesive has a color other than black.

18. The method according to claim 14 in which said semi-transparent image forming layer has a different color from the color of said image forming layer.

19. The method according to claim 14 in which the adhesive has a UV ground tint that reacts with ultraviolet radiation.

20. The method according to claim 14 in which the adhesive has a ground tint that reacts with ultraviolet radiation to enhance the glossiness of the adhesive and image forming layer.

* * * * *